US005546168A

United States Patent [19]

Adachi et al.

[11] Patent Number: 5,546,168

[45] Date of Patent: Aug. 13, 1996

[54] IMAGE FORMING APPARATUS WITH SELECTIVE OPERATION IN DOCUMENT-FIX READING MODE AND DOCUMENT-MOVE READING MODE

[75] Inventors: Seiichiro Adachi, Yokohama; Masataka Naito, Kawasaki; Masakazu Hiroi, Yokohama, all of Japan

[73] Assignee: Canon Kabushiki Kaisha, Tokyo, Japan

[21] Appl. No.: 172,054

[22] Filed: Dec. 23, 1993

[30] Foreign Application Priority Data

Dec. 28, 1992 [JP] Japan ..... 4-358854

[51] Int. Cl.[6] ..... G03G 15/28

[52] U.S. Cl. ..... 355/233; 355/309; 355/323

[58] Field of Search ..... 355/210, 233, 355/234, 235, 308, 309, 313, 321, 322, 323

[56] References Cited

U.S. PATENT DOCUMENTS

| | | | |
|---|---|---|---|
| 4,607,948 | 8/1986 | Naito . | |
| 4,930,761 | 6/1990 | Naito et al. . | |
| 4,937,623 | 6/1990 | Nishimori et al. | 355/233 |
| 4,986,520 | 1/1991 | Shido et al. . | |
| 5,029,315 | 7/1991 | Morikawa et al. | 355/235 |
| 5,090,673 | 2/1992 | Kitahara et al. . | |
| 5,237,382 | 8/1993 | Matsumura | 355/323 |
| 5,255,908 | 10/1993 | Hiroi et al . | |

*Primary Examiner*—Sandra L. Brase

*Attorney, Agent, or Firm*—Fitzpatrick, Cella, Harper & Scinto

[57] ABSTRACT

A copying apparatus has a recirculating document feeder; an exposure device for scanning and exposing the fed document sheets fed onto the document table by the document recirculating device; an image forming device for forming the images on the scanned and exposed document sheets; and a sheet receiving device for receiving and storing the recording medium sheets carrying images formed by the image forming device. The copying apparatus provides a first selecting device for selecting one of a first exposure mode in which the document recirculating device temporarily stations the document sheets on the document table while the exposure device is moved to scan and expose the stationary document sheets and a second exposure mode in which the document recirculating device continuously moves the document sheets on the document table to cause the document sheets to be scanned and exposed; a second selecting device for selecting one of a first receiving mode in which a set of recording medium sheets corresponding to the stack of documents are received and stored in each of a plurality of trays and a second receiving mode in which each of the trays receives and stores a plurality of recording medium sheets corresponding to one of the document sheets; and a control device for controlling the timing of change of the tray into which sheets are ejected in accordance with the modes selected by the first and second selecting devices.

10 Claims, 6 Drawing Sheets

IMAGE FORMING APPARATUS WITH SELECTIVE OPERATION IN DOCUMENT-FIX READING MODE AND DOCUMENT-MOVE READING MODE

BACKGROUND OF THE INVENTION

1. Field of the Invention

The present invention relates to an image forming apparatus of the type which forms an image either in a first exposure mode in which an original document circulated by a document recirculation means is stationed on a document table while an exposure means is moved to expose and scan the original document or a second exposure mode in which an original document is moved across the document table by the document recirculating means while being exposed and scanned by a stationary exposure means. More specifically, the present invention is concerned with an image forming apparatus of the type described, wherein recording medium sheets having images formed thereon are stored in a storage means having a plurality of storage sections.

2. Description of the Related Arts

Image forming apparatuses have been proposed which selectively operate either in "document-fix" reading mode or in "document-move" reading mode. The term "document-fix mode" is used to mean an image forming operation mode in which a plurality of document sheets fed by a recirculation type document feeder are successively placed on suitable portions of a platen, and are fixed while an image reading means in the apparatus is moved to scan and read the images of these document sheets. The "document-move" mode is a mode in which the image reading means is stationed at a suitable position, and is kept stationary while document sheets are successively fed by the recirculation type document feeder so as to move relative to the image reading means so that the images on the document sheets are read during movement of the document sheets.

In the known image forming apparatuses of the kind described, the document-move reading mode is employed for the purpose of realizing high-speed and stable reading of the original image, as well as image formation, particularly in a 1 to 1 copying operation where a single copy is produced from each original document sheet. When the document-move reading mode is used, it is possible to obtain a high image productivity, e.g., 100% or higher, by shortening the interval between sheets in the image forming apparatus. The document-fix reading mode, however, is advantageously employed in the so-called 1 to N fashion, i.e., when plural (N) copies are to be produced from a single document sheet, and, in particular, where stacking of sheets carrying the same image is required. When this mode is used, the productivity is 100% at the greatest. In order to increase the image forming speed per unit time, it is necessary to enhance the process speed of the image forming apparatus and the speed of circulating the original document sheets. This naturally leads to difficulties or problems such as necessity for motors having greater capacities and structure having higher rigidity, as well as problems from a rise in the noise level and a reduction in the reliability of the document feeding operation.

SUMMARY OF THE INVENTION

Accordingly, an object of the present invention is to provide an image forming apparatus which can eliminate the above-described problems of the known art.

Another object of the present invention is to provide an image forming apparatus having improved productivity.

In accordance with these objects, there is provided an image forming apparatus comprising document sheet recirculating means for separating document sheets from a stack of document sheets, feeding the separated document sheets onto a document table, and returning the document sheets from the document table to the stack, thereby recirculating the document sheets; exposure mans for scanning and exposing the document sheets fed onto the document table by the document recirculating means, the exposure means operating in one of a first exposure mode in which the document recirculating means temporarily stations each document sheet on the document table while the exposure means is moved to scan and expose the stationary document sheet and a second exposure mode in which the exposure means remains stationary while the document recirculating means moves each document sheet across the document table to cause the document to be scanned and exposed; image forming means for forming images on recording sheets from the document sheets that have been scanned and exposed by the exposure means; sheet receiving means for receiving and storing the recording sheets carrying images formed by the image forming means, the sheet receiving means having a plurality of sheet receiving portions; exposure mode selecting means for selecting one of the first exposure mode and the second exposure mode; and control means for controlling the sheet receiving means in one of a first receiving mode in which the receiving portion of the receiving means into which the recording sheets are received is changed upon each recirculation of the stack of document sheets and a second receiving mode in which the receiving portion into which the recording sheets are received is changed for each recording sheet received, wherein the control means selects the receiving mode in accordance with the exposure mode selected by the exposure mode selecting means.

In accordance with another aspect of the present invention, there is provided an image forming apparatus as set firth above, including exposure mode selecting means for selecting one of the first exposure mode and the second exposure mode, and control means for controlling the sheet receiving means such that, when the second exposure mode has been selected by the exposure mode selecting means, the receiving portion of the receiving means into which the recording sheets are received is changed upon each recirculation of the stack of document sheets.

In yet another aspect of the present invention there is provided an image forming apparatus as set froth above, including first selecting means for selecting one of the first exposure mode and the second exposure, second selecting means for selecting one of a first receiving mode in which a set of recording medium sheets having images corresponding to those on the stack of document sheets are received and stored in each of a plurality of sheet receiving portions of the sheet receiving means and a second receiving mode in which each sheet receiving portion of aid sheet receiving means receives and stores a plurality of recording medium sheets having images corresponding to that on one of the document sheets, and control means for controlling the sheet receiving means so that the sheet receiving portion into which sheets are received is in accordance with the modes selected by the first and second selecting means.

The above and other objects, features and advantages of the present invention will become clear from the following description taken in conjunction with the accompanying drawings.

DESCRIPTION OF THE PREFERRED EMBODIMENTS

Figure 1:
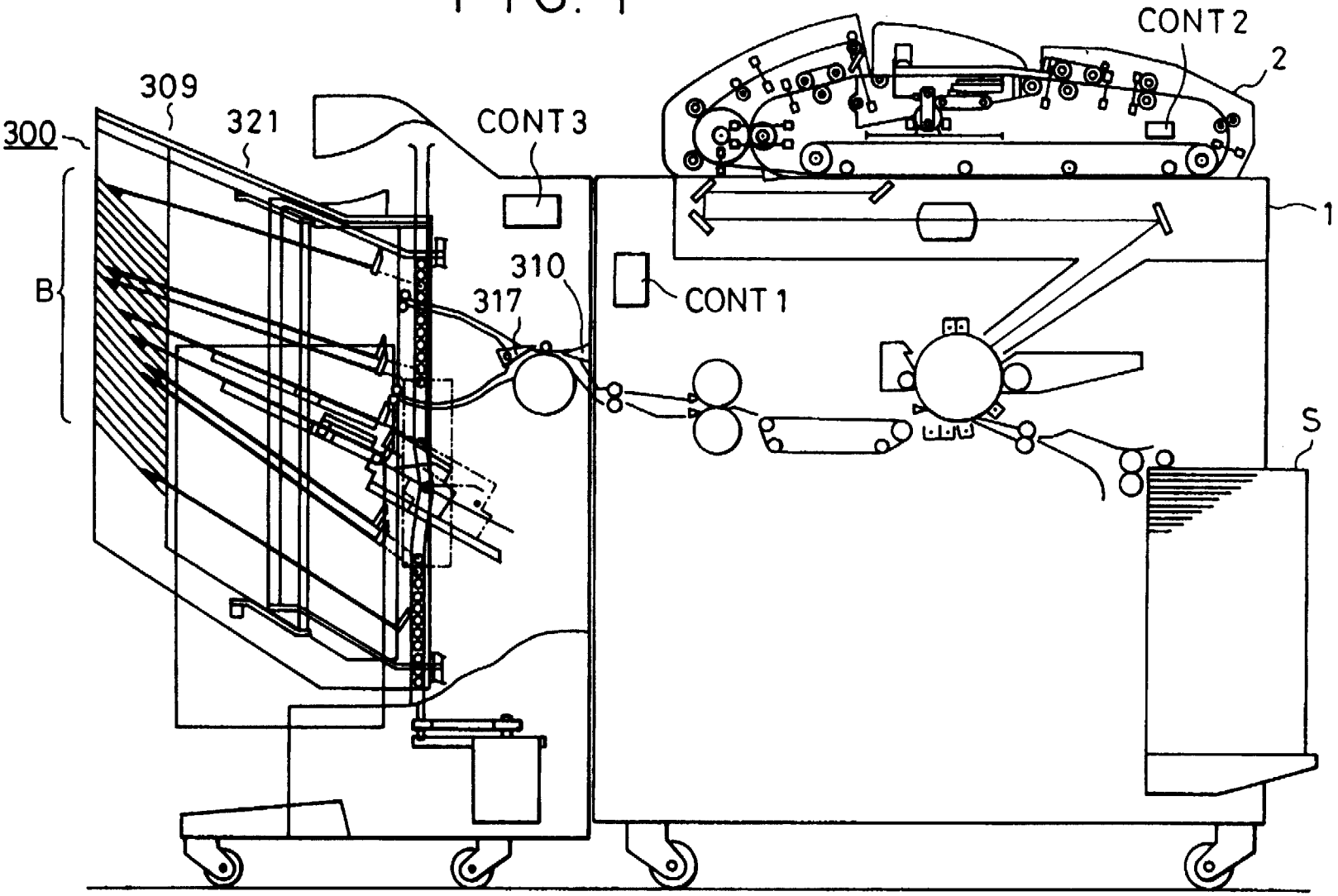
FIG. 1 is a sectional view of an embodiment of the image forming apparatus in accordance with the present invention.
Figure 6:
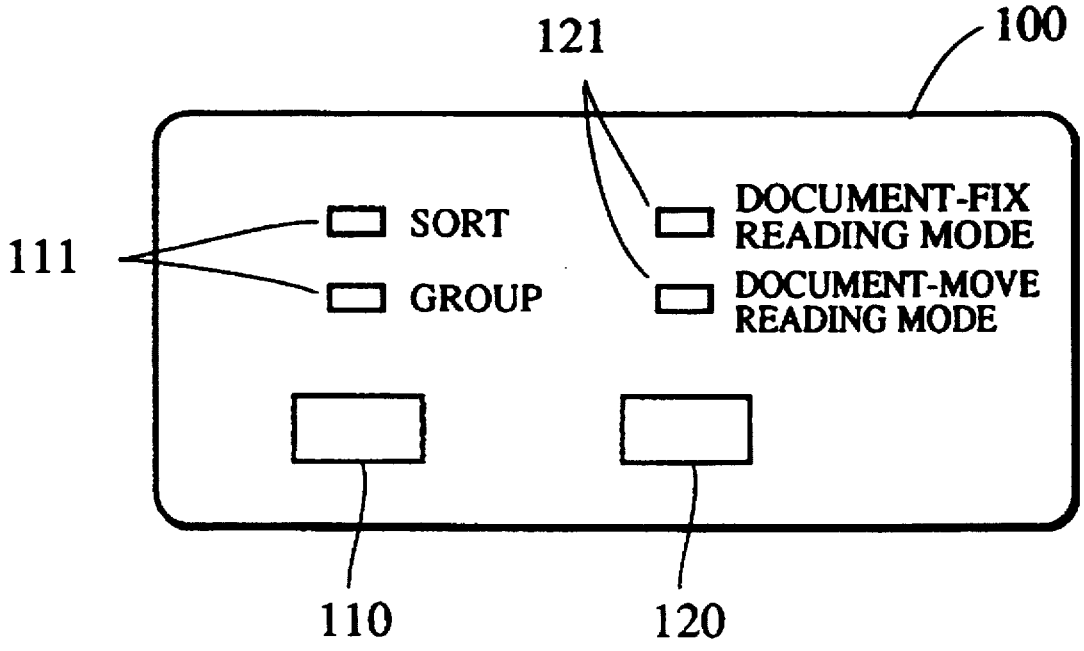
FIG. 6 is an illustration of an operation section for setting operation modes of a recirculation type document feeder and a sorter.

Referring first to FIG. 1 which is a sectional view of an image forming apparatus embodying the present invention, an analog-type image forming section 1 is constructed such that a recirculation type document feeder (referred to as "RDF", hereinafter)) 2 and a sheet post-processing device (referred to as a "sorter", hereinafter) 300 are connectable thereto. An operation section 100 arranged on the upper surface of the image forming section 1 has, as shown in FIG. 6, keys 110 and 120 for setting the modes of operations of the RDF 2 and the sorter 300.

The RDF 2 is operable selectively either in document-fix reading mode in which an optical system in the image forming section 1 is moved relative to plural original document sheets successively placed and held in position on the platen by the RDF 2 so as to read the images of these document sheets or in document-move reading mode in which the optical system is stationary at a suitable position while the document sheets are successively fed and moved relative to the stationary optical system so as to enable the optical system to scan and read the original images. The image forming apparatus has mutually communicable controllers CONT 1 to CONT 3. The controller CONT 1 controls the image forming sequence executed by the image forming section 1. The controller CONT 2 controls the document feeding sequence executed by the RDF 2. The controller CONT 3 controls the sheet sorting process performed by the sorter 300. Each of the controllers CONT 1 to CONT 3 has a CPU, ROM and a RAM which are not shown. These controllers communicate with one another through communication interfaces (not shown) so as to systematically control the image forming operation and sheet sorting operation in accordance with a flow which will be described later.

In the image forming apparatus having the described construction, the control means including the controllers CONT 1 to CONT 3 selects a first or second sorting mode in accordance with the exposure mode selected by mode selecting means (operation section). Consequently, the efficiency of sorting operation performed by the sorter 300 is remarkably improved regardless of whether the RDF 2 is operating in the document-move reading mode or in the document-fix reading mode, whereby sheet sorting can be achieved with high throughput.

Figure 2:
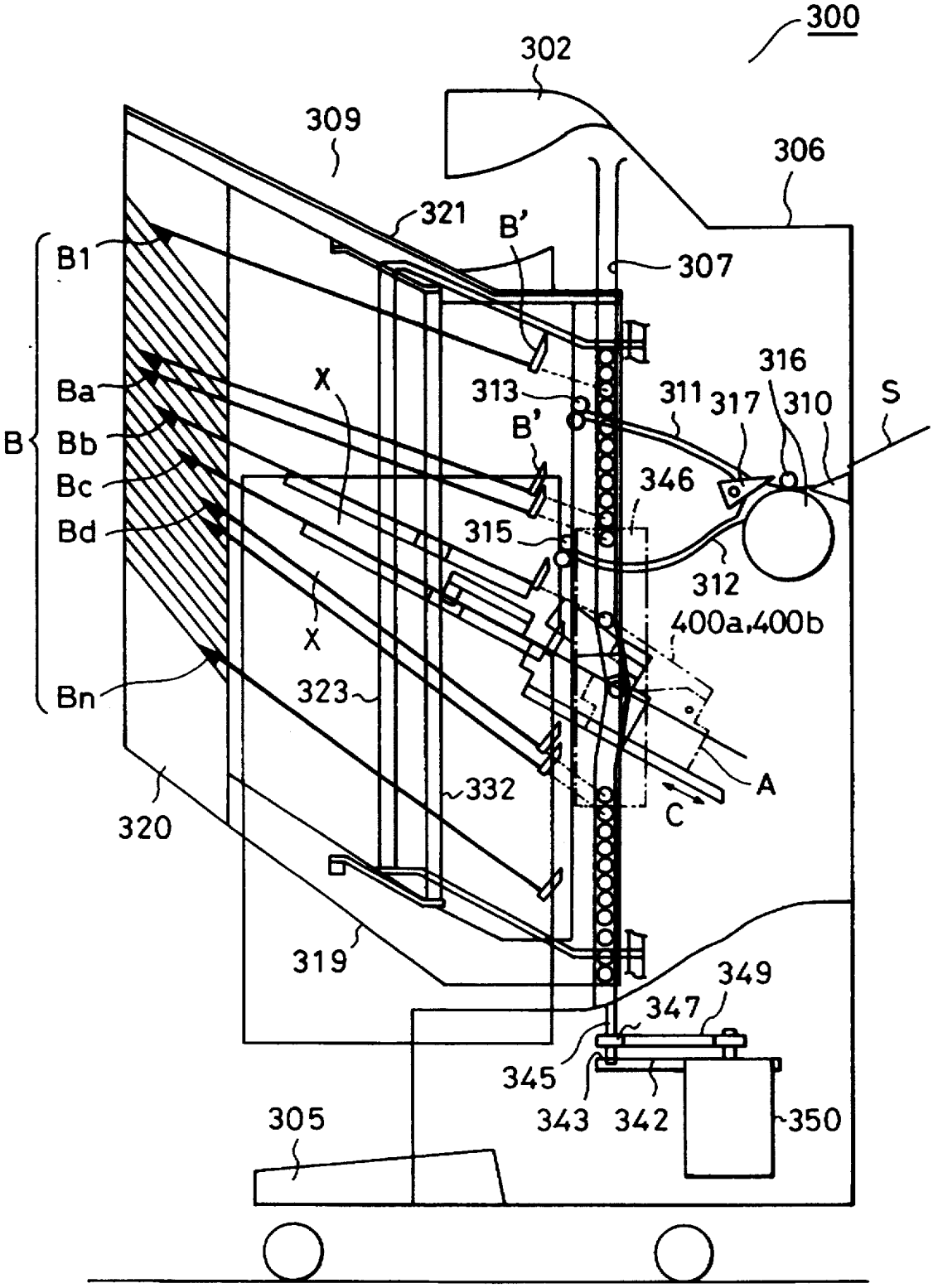
FIG. 2 is a detailed sectional view of the embodiment shown in FIG. 1 illustrating particularly the construction of a sorter.
Figure 3:
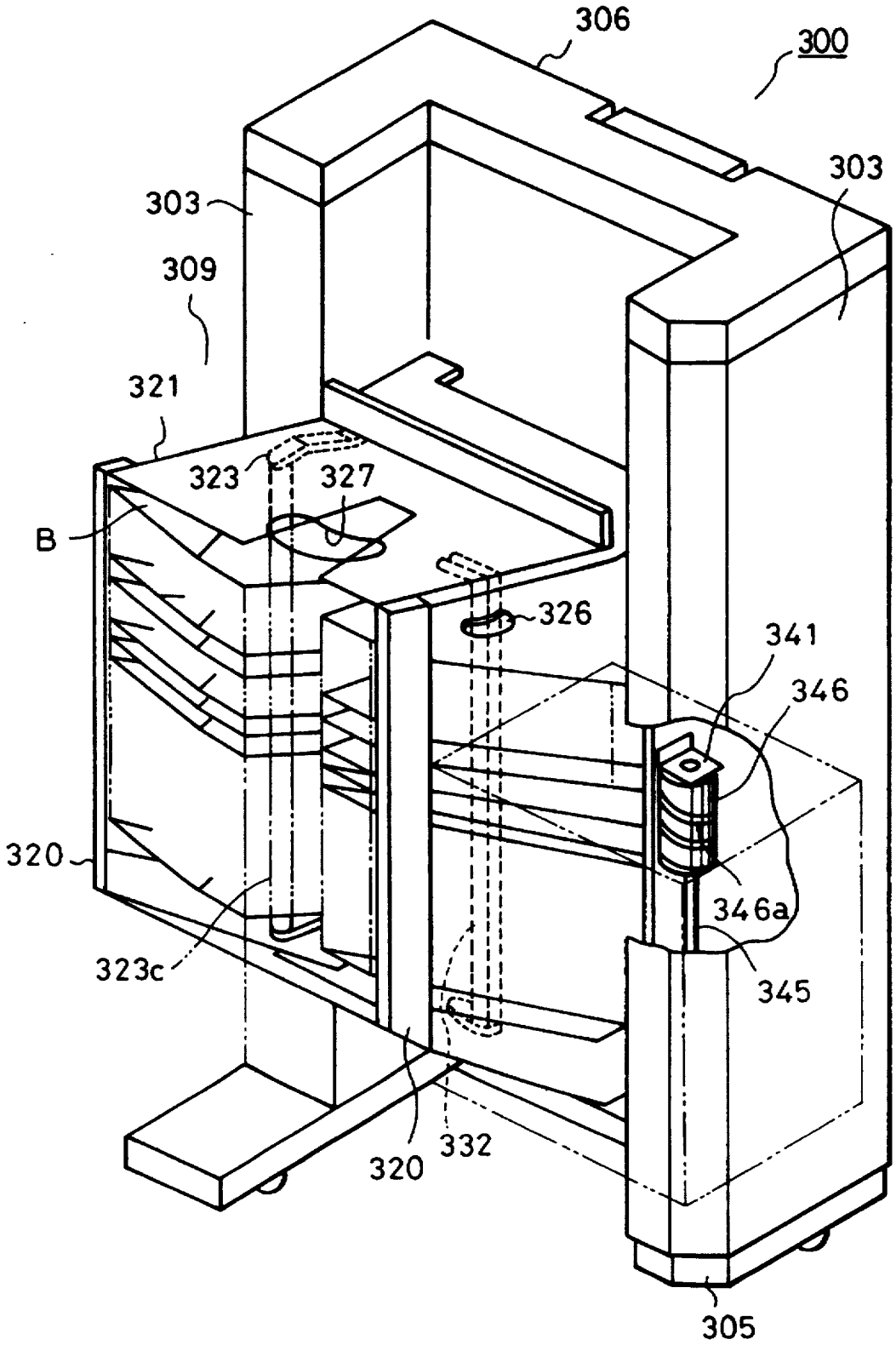
FIG. 3 is a perspective view of a portion of the sorter shown in FIG. 2.

FIG. 2 is a sectional view of the sorter incorporated in the apparatus shown in FIG. 1, while FIGS. 3 is a perspective view of portions of the sorter shown in FIG. 2.

A detailed description will now be given of the construction and operation of the embodiment.

The sorter 300 has a sorter body 306 which includes, as shown in FIGS. 2 and 3, a pair of side walls 303, a base 305 and a cover 302. The sorter 300 further has guide rails 307 laid on the sorter body 306 and a bin unit 309 which is vertically movable along the guide rails 307.

Referring to FIG. 2, the sorter body 306 is provided with a sheet inlet 310 which receives a sheet S ejected from the image forming section 1. A first sheet conveyance path 311 extends from the sheet inlet 310 towards the bin unit 309. A second sheet conveyance path 312 branches from the first sheet conveyance path 311. A pair of upper eject rollers 313 for ejecting non-sort sheet are disposed downstream of the first sheet conveyance path 311, while a pair of lower eject rollers 315 for ejecting sorted sheets are disposed downstream of the second sheet conveyance path 312.

A pair of sheet receiving rollers 316 and a deflector 317 are disposed in the region where the second sheet conveyance path 312 branches from the first sheet conveyance path 311. The deflector 317 is displaceable between two positions. More specifically, when a non-sort mode in which the sheets from the image forming section are stacked without being sorted is selected, the deflector 317 is displaced to a position where it guides the sheets S to the first sheet conveyance path 311, whereas, when a sort mode is selected, the deflector 317 is displaced to a position where it guides the sheets S to the second sheet conveyance path 312.

Figure 4:
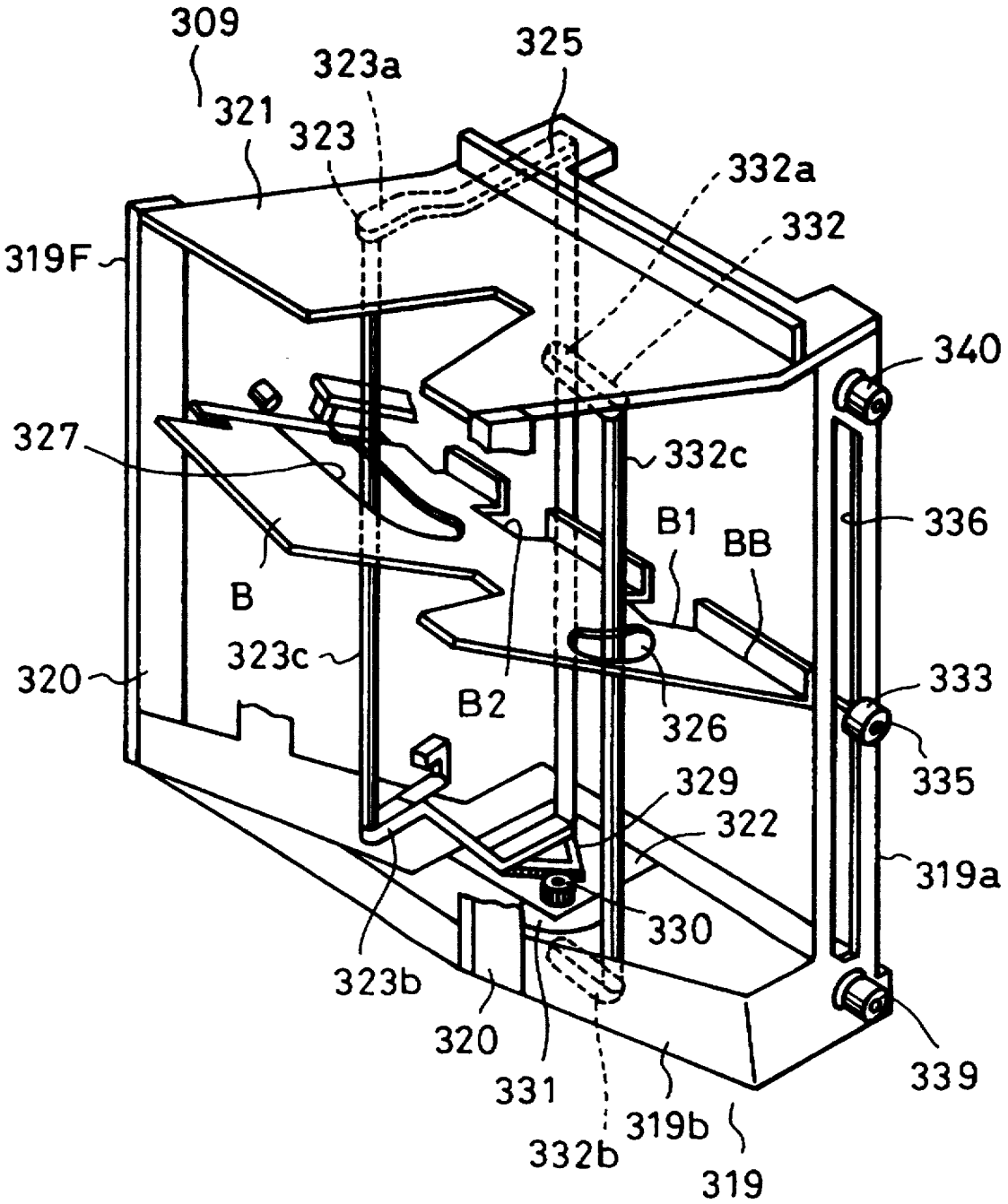
FIG. 4 is a perspective view of a part of the sorter shown in FIG. 3.

As shown in FIG. 4, the bin unit 309 has a pair of bin frames 319 which are disposed at the front side and the rear side of the sorter as viewed from the position where the operator stands. Each of the bin frames 319 has an upright portion 319*a* and a base portion 319*b*. A bin slider 320 is attached to the end of the bottom portion 319*b* of the bin frame 319. The ends of the upright portions 319*a* and the ends of the bin sliders 320 of the bin frames 319 are fixed together by means of a bin cover 321.

A support plate 322 is fixed to the innermost end of the base portion of the bin frame 319. A pivot shaft 325 is connected between this support plate 322 and the bin cover 321. Upper and lower arms 323*a* and 323*b* are arranged to swing around the pivot shaft 325. A first register bar 323*c* is fixed to free ends of the upper and lower arms 323*a*, 323*b* so as to vertically extend therebetween. The upper and lower arms 323*a*, 323*b* and the first register bar 323*c* form a first register member 323.

The first register bar 323*c* extends through slits 327 formed in the bins B so as to push the sheets S towards the front side to register these sheets.

A sector gear 329 is rotatably supported on the support plate 322 for rotation about the pivot shaft 325. The lower arm 323*b* of the first register member 323 is fixed to the sector gear 329. A pinion 330 meshing with the sector gear 329 is attached to a pulse motor 331 which is fixed to the underside of the support plate 322.

An upper arm 332*a* and a lower arm 332*b* are respectively secured to the underside of the bin cover 321 and to a left front part of the bin frame 319 for pivot motion about vertical axes. A second register bar 332*c* is connected between the ends of the upper arm 332*a* and the lower arm 332*b* so as to extend vertically therebetween. The upper arm 332*a*, the lower arm 332*b* and the register bar 332*c* form a second register member 332. The second register bar 332*c* extends through slits 326 formed in the bins B and is adapted to be actuated by actuating means (not shown) so as to push the sheets S towards the rear side, thus registering these sheets S.

Each of the bins B mounted in the bin unit 309 has one end movably received in comb teeth formed in the bin sliders 320. Pins 335 are fixed to the front and rear sides (as viewed from the position where the operator stands) of the base end of the bin B. These pins 335 extend through slits 336 formed in the front and rear upright portions 319*a*. These pins 335 carry trunnions 333 which are received in the front and rear guide rails 307, respectively, such that the trunnions 333 of the adjacent bins B are stacked one on the other in each of the guide rails 307. In each of the guide rails 307, the trunnion 333 of the lowermost bin contacts a lower guide roller 339 which is rotatably supported by the upright portion 319*a* of the bin frame 319 (bin frame of the rear side is not shown). Thus, the bins are held by the bin unit 309 with a pitch or spacing which is equal to the diameter of the trunnion 333. The bins are held at such an inclination that the base end adjacent to the image forming section is at a level lower than that of the distal end. A stopper B' is provided on the lower end, i.e., on the base end, of each bin B, as shown in FIG. 2. The bin unit 309 also has upper guide rollers 340 in addition to the lower guide rollers 339. The upper and lower guide rollers 340 and 339 are received in the guide rails 307 so that the bin unit 309 as a whole is movable up and down along the guide rails 307.

Cam shaft holders 341 are disposed on the portions of the side walls 303, 303 which opposes electric staplers 400*a*, 400*b* and the lower eject roller pair 315. A motor base 342 carried on the bottom portion of the sorter body 306 has a bearing 343. A lead cam shaft 345 has an end rotatably borne by the bearing 343 and extends upward therefrom so as to be supported by the cam shaft holder 341. A lead cam 346 is fixed to the lead cam shaft 345 to which is fixed also a pulley 347. The pulley 347 is driven through a belt 349 by a shift motor 350 secured to the underside of the motor base 342.

The lead cam 346 is positioned so as to oppose the lower eject roller pair 315. The trunnions of the bins Ba to Bd engage with a spiral groove 346*a* formed in the lead cam 346. The arrangement is such that the spacing X (see FIG. 2) between the bins Ba to Bd is increased so that the bin brought to the position of the lower eject roller pair 315 can easily receive the sheet S delivered from the pair of eject rollers 315.

The guide rails 307 are partly curved such that each bin, e.g., the bin Bc in FIG. 2, is projected forward when its corresponding trunnion enters the curved region. This also contribute to ease of receipt of the sheet S.

A description will now be given as to the modes of handling of the sheets S delivered from the image forming section 1. Successive sheets S ejected from the image forming section 1 are introduced into the sorter 300 through the inlet 310 and are guided to the first sheet conveyance path 311 or the second sheet conveyance path 312 by the deflector 317 which is displaced according to the mode, i.e., depending on whether the non-sort mode (the mode in which the sheets are not sorted) or the sort mode (the mode in which the sheets are sorted) is selected.

When the non-sort mode has been selected, the sheets S are guided into the first sheet conveyance path 311 and are ejected by the upper pair of eject rollers 313 onto bin cover 321, which also serves as the top bin of the bin unit 309, where the sheets S are stacked.

When the sort mode has been selected, the lead cams 346 are rotated so that the trunnions 333 engaging with the spiral groove 346*a* of the lead cam 346 are successively moved. The upper guide rollers 340 or the lower guide rollers 339 are pushed by the moving trunnions 333 so as to move up or down. The sheets S are advanced through the second sheet conveyance path 312 and are ejected by the lower pair of eject rollers 315 onto the first bin B1 and other bins which are successively opened to receive the sheets.

The sheet S ejected onto the bin Bb, which has been brought to the position opposing the lower pair of eject rollers 315, slides down the incline of bin Bb, due to the action of gravity, until it is stopped by the stopper B'. Meanwhile, the second register member 332 has been actuated by an actuating means (not shown) to a reference position for the sheet S. The first register bar 323*c* is then activated by a pulse motor 331 in accordance with a predetermined pulse signal corresponding to the size of the sheet S, so as to press the side edge of the sheet S against the second register member 332. The first register bar 323*c* is then returned to the stand-by position to prepare for ejection of the next sheet S.

The described operation is repeated so that a plurality of sheets S are held by each bin, e.g., the bin Bb, such that the trailing ends of the sheets S are registered in contact with the stopper B' while the longitudinal sides of the sheets are registered due to contact with the second register member 332.

The sheets S held by each of other bins B are registered in the same manner due to the action of the first register bar 323*c* which extends through the slits formed in all the bins B. When the electric staplers 400*a*, 400*b* are moved to the stapling position, the controller CONT 3 produces a stapling enable signal, so that the staplers 400*a*, 400*b* are actuated to drive the staples through the stack of the sheets S. After the stapling operation, the electric staplers 400*a*, 400*b* are retracted to a position "A" shown in FIG. 2, thus completing stapling operation on one of the bins. When the described stapling operation is to be conducted on a plurality of bins, the highest efficiency is obtained when the stapling is commenced with the bin which has received the last sheet ejected by the lower pair of eject rollers 315. More specifically, the electric staplers 400*a*, 400*b* perform the series of stapling operations in response to a bin shift completion signal and, after completion of the stapling operation, a stapling completion signal is emitted to initiate the next bin shift operation. This cycle is repeated to complete the stapling on the sheet stacks of all the bins.

In the illustrated embodiment, the sheets S in each bin B can be registered without fail, by virtue of the cooperation between the first register member 323 provided on the bin unit 309 and the second register member 332 provided on the bin frame 319 of the bin unit 309. In addition, since the register of the sheets is effected by the movement of the register bar 323*c* which extends through the slits 327 formed in all the bins B, and since the register member 323 including this bar 323*c* is mounted on the bin unit 309, the registering operation can be conducted at any time after the ejection of the sheet onto the bin B, even during shifting of the bins. Namely, the registration of the sheet S can be effected at any suitable timing except for the transient period in which the sheet is being introduced into the bin B.

Furthermore, the illustrated embodiment ensures that the sheet registering operation can always be conducted in a stable manner because both the first and second register members 323, 332 swing about the pivot shaft 325 which is carried by the bin unit 309 integrally therewith.

In the illustrated embodiment, the sheets are registered at the front longitudinal sides of the sheets as viewed from the position where the operator stands. This, however, is not exclusive and the arrangement may be such that the sheets are registered at their rear longitudinal sides of the sheets. The described embodiment therefore may be modified such that the sheets S are pushed by the second register member 332 against the first register member 323 which is kept stationary to serve as a reference.

It should be noted that the bin-shift type sorter using lead cams employed in the described embodiment is illustrative and any other suitable sorter, such as a bin-shift type sorter incorporating a Geneva mechanism, as well as a bin-fixed type sorter, may be used equally well in the present invention.

Figure 5:
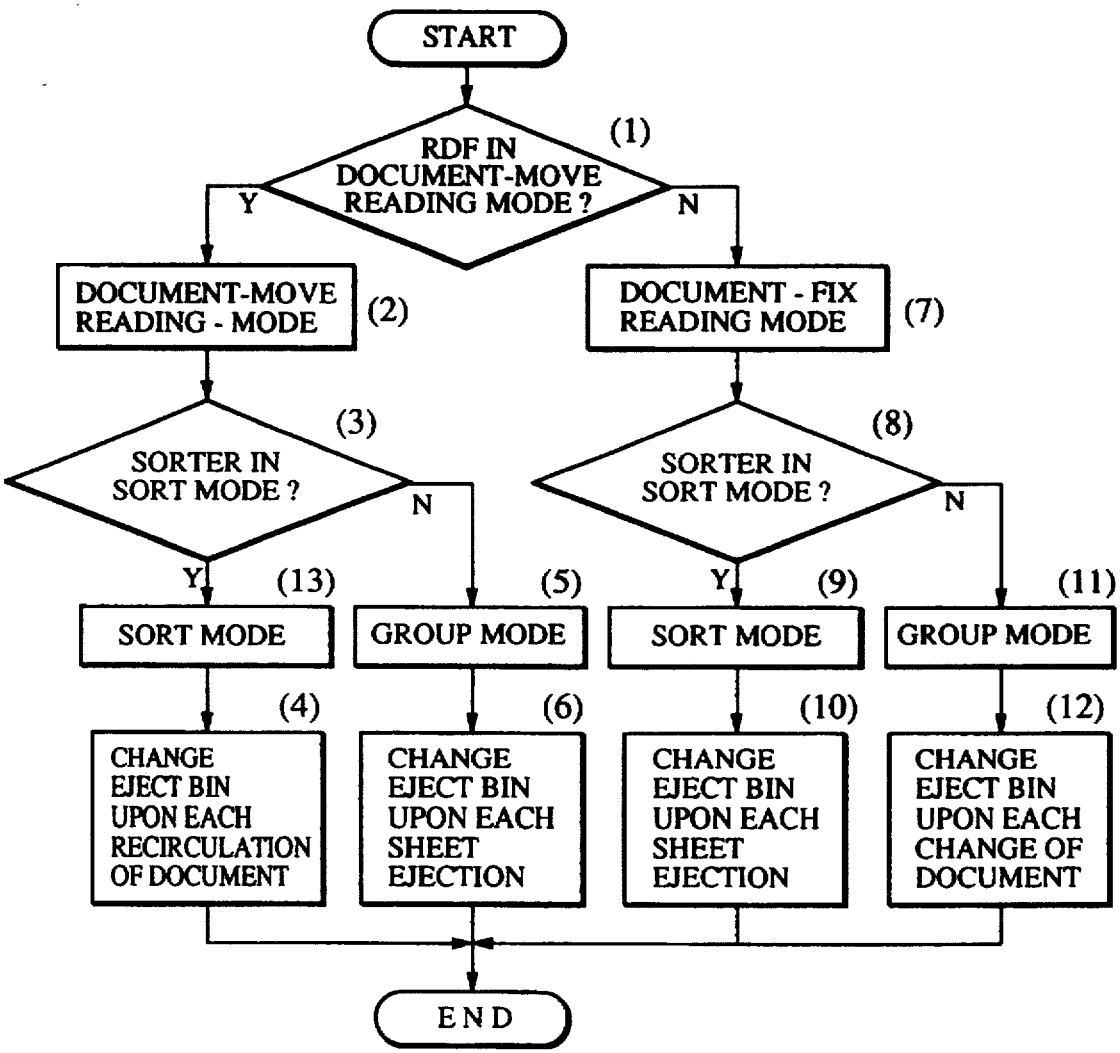
FIG. 5 is a flow chart showing sheet sorting control processes executed in different image reading modes performed by the image forming apparatus.

A description will now be given of the sheet control operations in different image reading modes performed in the image forming apparatus of the present invention. The description is given with reference to the flow chart shown in FIG. 5 which shows, by way of example, processes executed by the controllers CONT1 and CONT2 of the image forming section 1.

As the process is started, whether or not the RDF 2 is in the document-move reading mode is determined in Step (1). If the RDF 2 is in the document-move reading mode, an answer YES is given so that the process proceeds to Step (2) which sets the document-move reading mode. Then, in Step (3), whether or not the sorter 300 is in the sort mode is determined. If the answer is YES, the process proceeds to Step (13) which sets the sort mode. The process then proceeds to Step (4) in which a change of the eject bin is executed upon each recirculation of the documents, thus completing the process.

Conversely, if the answer to the question posed in Step (3) is NO, a group mode is set as the operation mode of the sorter 300 in Step (5) and, in Step (6), a change of the eject bin is executed in response to each ejection of the sheet, thus completing the process, while the drive of the bins is controlled.

On the other hand, if the answer to the question posed in Step (1) is NO, the process proceeds to Step (7) in which the document-fix reading mode is set as the operation mode of the RDF 2. The process then advances to Step (8) which determines whether the operation mode of the sorter 300 is the sort mode. If the answer is YES, the process proceeds to Step (9) which sets the sort mode. Then, in Step (10), driving of the eject bins is so controlled that the eject bin is changed in response to each sheet ejection, thereby completing the process.

Conversely, if the answer NO is given in Step (8), the process proceeds to Step (11) in which a group mode is set as the operation mode of the sorter 300. Then, in Step (12), driving of the eject bins is controlled such that the eject bin is changed upon each change of the document, thus finishing the process.

Thus, in the described embodiment, the driving of the eject bins is optimally controlled in accordance with the reading mode of the RDF and the mode of operation of the sorter. More specifically, it is assumed here that N document sheets (a, b, c, . . . , n) are read by the RDF 2 to obtain a plurality of copy sheets carrying the image of each of the N documents, e.g., copy sheets a1, a2, a3 and so forth which are the first, second, third and other sheets carrying the image of the first document "a", copy sheets b1, b2, b3 and so forth which are the first, second, third and other sheets carrying the image of the second document "b", and so on. The sort mode is the mode which produces plural sets of the copy sheets, each set including a copy sheet carrying the image of the first document "a", a copy sheet carrying the image of the second sheet "b", a copy sheet carrying the image of the third sheet "c", and so forth If this sort mode has been selected while the RDF has been set to operate in the document-move reading mode, the series of documents (a, b, c, . . . , n) are recirculated plural times corresponding to the number of the sets of the copy sheets to be obtained. Consequently, copy sheets are obtained and ejected in the sequence a1, b1, c1, . . . , a2, b2, c2, . . . , a3, b3, c3, . . . , and so forth. Meanwhile, in the sorter 300, the bins are shifted in response to each recirculation of the copy sheets, so that the copy sheets a1, b1, c1, d1 . . . and so on are stacked in sequence on the bin B1, and the copy sheets a2, b2, c2, d2 . . . and so forth are stacked in sequence on the bin B2.

In contrast, when he RDF 2 has been set to the document-fix reading mode, copy sheets a1, a2, a3 . . . , are formed for the first document "a". Meanwhile, in the sorter 300, the bins B are shifted each time the copy sheet is ejected from the image forming section, whereby the sets of copy sheets are obtained on the successive bins such that the copy sheets a1, b1, c1, d1 . . . , and so forth are stacked on the bin B1, while the bin B2 carries the copy sheets a2, b2, c2, d2 . . . and s forth. In this case, the documents are circulated by the RDF 2 only once.

When the sorter is in the group mode in which plural copy sheets carrying image of each document sheet are stacked as a group, if the RDF 2 has been set to the document-move reading mode, copy sheets are ejected from the image forming section 1 in a sequence of a1, b1, c1, . . . , a2, b2, c2, . . . , a3, b3, c3, . . . . Meanwhile, in the sorter 300, the bins b are shifted each time a copy sheet is ejected from the image forming section 1, whereby the copy sheets are stacked in the respective bins such that the bin B1 carries the copy sheets a1, a2, a3, . . . , the bin B2 carries the sheets b1, b2, b3, . . . , and so forth.

In contrast, when the RDF has been set to operate in the document-fix reading mode, the image forming section produces image of the document "a" to provide copy sheets a1, a2, a3, . . . , and so forth. The sorter operates such that the bins are shifted each time the document is changed in the sorter 300. As a consequence, sheets a1, a2, a3 . . . , and so forth are carried by the bin B1, while the copy sheets b1, b2, b3, . . . , and so forth are stacked on the next bin B2.

As will be understood from the foregoing description, according to the present invention, the receiving mode for receiving the copy sheets is determined in accordance with the mode of operation of the exposure means selected by the control means. It is therefore possible to treat the copy sheets with a high throughput, regardless of whether the RDF has been set to the document-move reading mode or the document-fix reading mode.

While the present invention has been described with respect to what is presently considered the preferred embodiments, it is to be understood that the invention is not limited to the described embodiments. The present invention is intended to cover various modifications and equivalent arrangements included within the spirit and scope of the appended claims.

What is claimed is:

1. An image forming apparatus comprising:

document sheet recirculating means for separating document sheets from a stack of document sheets, feeding the separated document sheets onto a document table, and returning the document sheets from the document table to the stack, thereby recirculating the document sheets;

exposure means for scanning and exposing the document sheets fed onto the document table by said document recirculating means, said exposure means operating in one of a first exposure mode in which said document recirculating means temporarily stations each document sheet on the document table while said exposure means is moved to scan and expose the stationary document sheet and a second exposure mode in which said exposure means remains stationary while said document recirculating means moves each document sheet across the document table to cause the document to be scanned and exposed;

image forming means for forming images on recording sheets from the document sheets that have been scanned and exposed by said exposure means;

sheet receiving means for receiving and storing the recording sheets carrying images formed by said image forming means, said receiving means having a plurality of sheet receiving portions;

first selecting means for selecting one of the first exposure mode and the second exposure mode;

second selecting means for selecting one of a first receiving mode in which a set of recording medium sheets having images corresponding to those on the stack of document sheets are received and stored in each of a plurality of sheet receiving portions of said sheet receiving means and a second receiving mode in which each sheet receiving portion of said sheet receiving means receives and stores a plurality of recording medium sheets having images corresponding to that on one of said document sheets; and control means for controlling said sheet receiving means so that the sheet receiving portion into which sheets are received is in accordance with the modes selected by said first and second selecting means, wherein said first selecting means and said second selecting means can perform the selecting operation independently.

2. An image forming apparatus according to claim 1, wherein said control means controls said sheet receiving means so as to change the sheet receiving portion into which sheets are received each time a recording medium sheet is received whenever said first exposure mode and said first receiving mode have been selected, respectively, by said first and second selecting means.

3. An image forming apparatus according to claim 1, wherein said control means controls said sheet receiving means so as to change the sheet receiving mode each time said document recirculation means completes recirculation of the document sheet stack whenever the second exposure mode and the first receiving mode have been selected, respectively, by said first and second selecting means.

4. An image forming apparatus according to claim 1, wherein said control means controls said sheet receiving means so as to change the sheet receiving portion into which sheets are received each time the document sheets on said document table are replaced by said document recirculating means whenever the first exposure mode and the second receiving mode have been selected, respectively, by said first and second selecting means.

5. An image forming apparatus according to claim 1, wherein said control means controls said sheet receiving means so as to change the sheet receiving portion into which sheets are received each time a recording medium sheet is received whenever the second exposure mode and the second receiving mode have been selected, respectively, by said first and second selecting means.

6. An image forming apparatus comprising:

document sheet recirculating means for separating document sheets from a stack of document sheets, feeding the separated document sheets onto a document table, and returning the document sheets from the document table to the stack, thereby recirculating the document sheets;

exposure means for scanning and exposing the document sheets fed onto the document table by said document recirculating means, said exposure means operating in one of a first exposure mode in which said document recirculating means temporarily stations each document sheet on the document table while said exposure means is moved to scan and expose the stationary document sheet and a second exposure mode in which said exposure means remains stationary while said document recirculating means moves each document sheet across the document table to cause the document to be scanned and exposed;

image forming means for forming images on recording sheets from the document sheets that have been scanned and exposed by said exposure means;

sheet receiving means for receiving and storing the recording sheets carrying images formed by said image forming means, said receiving means having a plurality of sheet receiving portions and operating in one of the first exposure mode and the second exposure mode;

selecting means for selecting one of a first receiving mode in which a set of recording medium sheets having images corresponding to those on the stack of document sheets are received and stored in each of a plurality of sheet receiving portions of said sheet receiving means and a second receiving mode in which each sheet receiving portion of said sheet receiving means receives and stores a plurality of recording medium sheets having images corresponding to that on one of said document sheets; and control means for controlling each combination of the first and second exposure modes and the first and second receiving modes.

7. An image forming apparatus according to claim 6, wherein said control means controls said sheet receiving means so as to change the sheet receiving portion into which sheets are received each time a recording medium sheet is received whenever said sheet receiving means is operating in the first exposure mode and said first receiving mode has been selected by said selecting means.

8. An image forming apparatus according to claim 6, wherein said control means controls said sheet receiving means so as to change the sheet receiving mode each time said document recirculation means completes recirculation of the document sheet stack whenever the sheet receiving means is operating the second exposure mode and the first receiving mode has been selected by said selecting means.

9. An image forming apparatus according to claim 6, wherein said control means controls said sheet receiving means so as to change the sheet receiving portion into which sheets are received each time the document sheets on said document table are replaced by said document recirculating means whenever said sheet receiving means is operating in the first exposure mode and the second receiving mode has been selected by said selecting means.

10. An image forming apparatus according to claim 6, wherein said control means controls said sheet receiving means so as to change the sheet receiving portion into which sheets are received each time a recording medium sheet is received whenever said sheet receiving means is operating in the second exposure mode and the second receiving mode has been selected by said selecting means.

* * * * *

UNITED STATES PATENT AND TRADEMARK OFFICE

CERTIFICATE OF CORRECTION

PATENT NO. : 5,546,168

DATED : August 13, 1996

INVENTOR(S) : Seiichiro Adachi, et al.

It is certified that error appears in the above-indentified patent and that said Letters Patent is hereby corrected as shown below:

Column 2,
line, 40, "firth" should read --forth--;
line 49, "froth" should read --forth--; and
line 57, "aid" should read --said--.
Column 3,
line 66, "FIGS. 3" should read --FIG. 3--.

Column 5,
line 26, "opposes" should read --oppose--; and
line 46, "contribute" should read --contributes--
Column 8,
line 13, "he" should read --the--;
line 20, "s" should read --so--;
line 24, "carrying" should read --carrying the--;
line 28, "c3....Meanwhile," should read --$c^3$....
Meanwhile,--; and
line 36, "image" should read --images--.

Signed and Sealed this

Twenty-fifth Day of March, 1997

*Attest:*

Bruce Lehman

BRUCE LEHMAN

*Attesting Officer*

*Commissioner of Patents and Trademarks*